US005472357A

United States Patent [19]

Yamanashi

[11] Patent Number: 5,472,357

[45] Date of Patent: Dec. 5, 1995

[54] LOW INSERTION FORCE CONNECTOR

[75] Inventor: Makoto Yamanashi, Shizuoka, Japan

[73] Assignee: Yazaki Corporation, Tokyo, Japan

[21] Appl. No.: 400,484

[22] Filed: Mar. 8, 1995

Related U.S. Application Data

[63] Continuation of Ser. No. 181,257, Jan. 13, 1994, abandoned.

[30] Foreign Application Priority Data

Jan. 13, 1993 [JP] Japan ..... 5-003979

[51] Int. Cl.[6] ..... H01R 13/516

[52] U.S. Cl. ..... 439/701; 439/924.1

[58] Field of Search ..... 439/540, 701, 439/924

[56] References Cited

U.S. PATENT DOCUMENTS 3,753,212 8/1973 Yamada et al. ..... 439/358
4,711,507 12/1987 Noorily ..... 439/292
5,344,347 9/1994 Inoue et al. ..... 439/924

FOREIGN PATENT DOCUMENTS 5-31153 4/1993 Japan .

*Primary Examiner*—Gary F. Paumen
*Attorney, Agent, or Firm*—Sughrue, Mion, Zinn, Macpeak & Seas

[57] ABSTRACT

A low insertion force connector for fitting a division connector, mounted on one connector, to a second connector in a staged manner, thereby reducing a connector insertion force. The division connector is mounted on the first connector for sliding movement of the first connector relative to the second connector in a connector fitting direction. After the division connector is fitted in the first connector, the first connector is fitted to the second connector. An elastic abutment arm having an abutment portion and a slanting portion is provided on the first connector, an engagement portion for the abutment portion is provided on the division connector, and an abutment release portion for urging the slanting portion to flex the elastic abutment arm is provided on the second connector.

5 Claims, 6 Drawing Sheets

LOW INSERTION FORCE CONNECTOR

This is a continuation of application Ser. No. 08/181,257, filed Jan. 13, 1994, now abandoned.

BACKGROUND OF THE INVENTION

1. Field of the invention

This invention relates to a low insertion force connector in which a division connector, mounted on one connector, and the one connector are fitted in the other connector in a staged manner, thereby reducing a connector insertion force.

2. Related Art

FIG. 7 is a vertical cross-sectional view of a conventional low insertion force connector.

The low insertion force connector 40 comprises a connector 42 for mounting on a door of-an automobile, in which connector a division connector 41 is mounted for sliding movement in a connector fitting direction, and a connector 45 for mounting on a body which connector includes a connection portion 43 for the division connector 41 and a connection portion 44 for the door-side connector 42.

The division connector 41 has an engagement projection 49 engaged with a lock portion 48 over a predetermined range which lock portion is provided in a through hole 47 in a door-side connector housing 46, and this division connector is slidable in the through hole 47. A front end portion 50 of the division connector is projected from a front end of the housing 46, and its rear end portion 51 is projected from a rear end of the housing 46.

The division connector 41 is pressed through a waterproof grommet 52 of the door-side connector 42, and is fitted on one connection portion 43 of the body-side connector 45. Then, the door-side connector 42 is pressed to cause a remaining connection portion 53 to fit on the other connection portion 44. Thus, the fitting of the connector is effected twice in a divided manner, that is, in stages, and therefore the connector insertion force becomes half, and the fitting operation is facilitated.

However, in the above conventional construction, the rear end portion 51 of the division connector 41 is covered with the grommet 52, and can not be viewed, and therefore the fitting operation between the division connector 41 and the body-side connector 45 can not be carried out easily. If the operator does not press the division connector 41, the division connector 41 slides toward the grommet 52, and the division connector 41 and the remaining connection portion 53 are not simultaneously fitted relative to the body-side connector 45, which results in a drawback that the low insertion force connector fails to perform its function.

SUMMARY OF THE INVENTION

With the foregoing in view, it is an object of this invention to provide a low insertion force connector in which a division connector and one connector can be fitted relative to the other connector in a staged manner, without pressing the division connector through a grommet, in such a manner that the division connector is positively kept out of phase with a remaining connection portion of the one connector during the fitting operation.

To achieve the above object, the present invention provides a low insertion force connector wherein a division connector is mounted on one connector for sliding movement in a connector fitting direction; and after the division connector is fitted in the other connector, the one connector is fitted in the other connector; wherein an elastic abutment arm having an abutment portion and a slanting portion is provided on the one connector; an engagement portion for the abutment portion is provided on the division connector; and an abutment release portion for urging the slanting portion to flex the elastic abutment arm is provided on the other connector.

The sliding movement (rearward movement) of the division connector is limited by the abutment of the engagement portion of the division connector against the abutment portion of the elastic abutment arm of the one connector, so that the division connector can be fitted in the other connector. Then, the abutment release projection of the other connector is caused to urge the slanting portion of the abutment arm to flex the elastic arm outwardly to release the engagement between the engagement portion and the abutment portion, thereby allowing the rearward movement of the division connector. At the same time, the one connector can advance toward the other connector, and a remaining connection portion of the one connector is fitted in the other connector, thereby achieving a positive staged fitting.

DETAILED DESCRIPTION OF THE PREFERRED EMBODIMENTS

Figure 1:
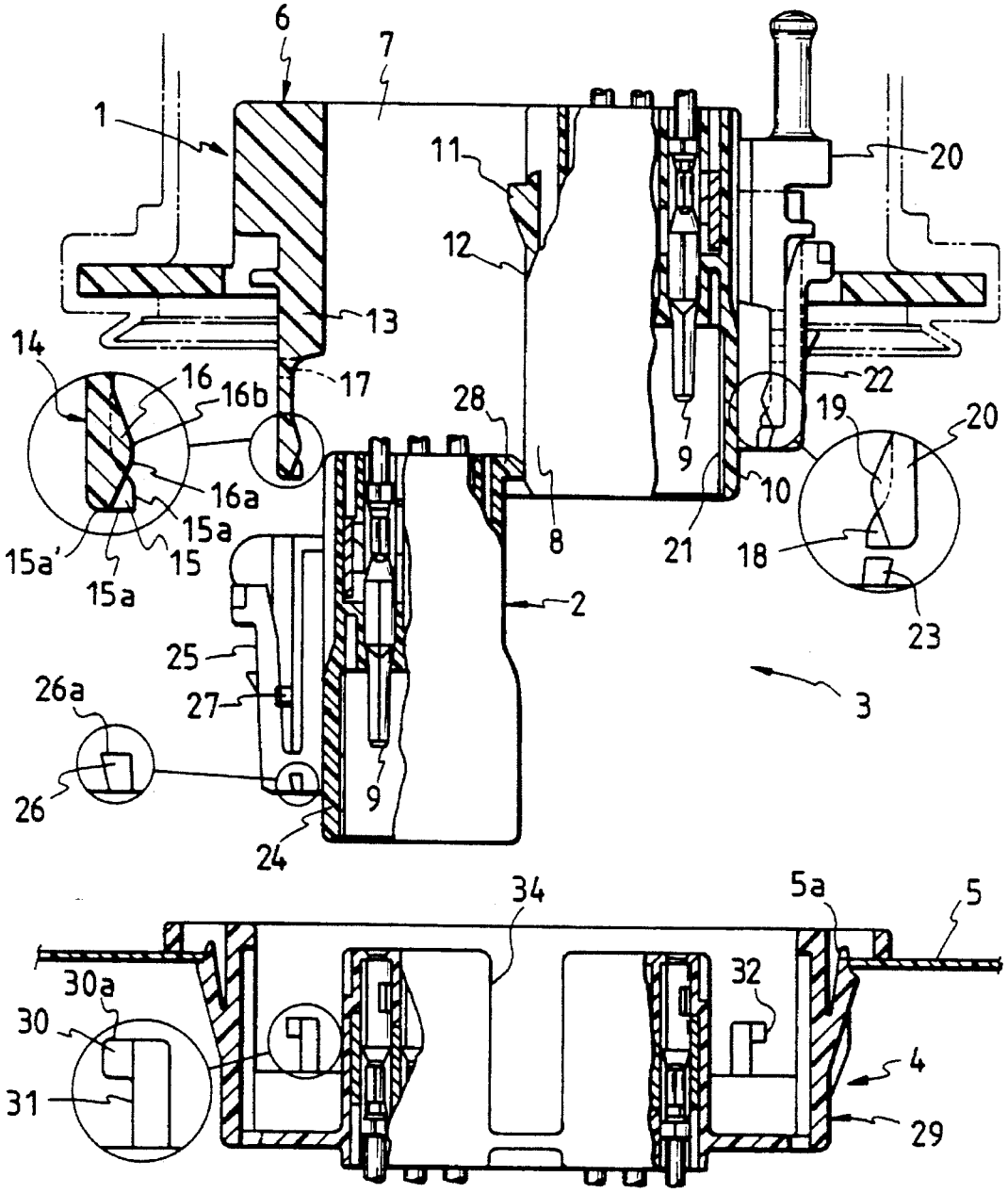
FIG. 1 is a vertical cross-sectional view of one embodiment of a low insertion force connector of the present invention in an exploded condition.

FIG. 1 is a vertical cross-sectional view of one embodiment of a low insertion force connector of the present invention.

In FIG. 1, reference numeral 1 denotes a connector body for mounting on a door of an automobile, and a division connector 2 is mounted on the door-side connector body 1 for sliding movement in a connector fitting direction, and cooperates with the connector body 1 to form a door-side connector 3. A body-side connector 4 is fixedly mounted on a body panel 5, and the division connector 2 and the door-side connector body 1 are sequentially fitted in this body-side connector in a staged manner.

A slide guide hole 7 for the insertion of the division connector 2 thereinto is formed through a left half portion of a housing 6 of the door-side connector body 1, and a connection portion 10 is provided in a right half portion isolated from the left half portion by a central partition wall 8, the connection portion 10 holding therein terminals 9 equal in number to terminals 9 in the division connector 2. An elastic stop arm 12, having an engagement projection 11 disposed in the guide hole 7, is formed integrally on a rear portion of the central partition wall 8. A straight, elastic abutment arm 14 for stopping the division connector 2 projected forwardly from the guide hole 7 is formed integrally on an outer wall 13 of the guide hole.

An abutment projection 15 having a horizontal abutment surface 15*a* is formed on a distal end of the elastic abutment arm 14, and also a slanting projection 16 having an inwardly-directed slanting surface 16*a* is formed on this distal end in overlapping relation to the abutment projection 15. The slanting surface 16*a* starts from a generally central point 15*a'* of the horizontal abutment surface 15*a*, and a peak 16*b* of this slanting surface is generally equal in height to an end 15*b* of the abutment projection 15. A retaining projection 17 for the division connector 2 is provided at a proximal end portion of the abutment arm 14, and is disposed in a direction perpendicular to the slanting projection 16.

A double-lock spacer 20, having an abutment projection 18 and a slanting projection 19 as in the above elastic abutment arm 14, is inserted in that portion on the outside of the right half portion of the door-side connector housing 6. The lock spacer 20 is inserted between a lock arm 22, formed on and projected from an outer wall 21 of the housing, and this outer wall 21 to prevent the flexing of the lock arm 22. An engagement projection 23 for the abutment projection 18 is formed at a proximal portion of the lock arm 22.

Similarly, a lock arm 25 is formed on an outer wall 24 of the division connector 2, and an engagement projection 26 for the abutment projection 15 of the elastic abutment arm 14 is formed at a proximal portion of the lock arm 25. The engagement projection 26 has a horizontal engagement surface 26*a* for abutment against an inner half of the horizontal abutment surface 15*a* of the abutment projection 15. An engagement projection 27 for the retaining projection 17 formed at the proximal portion of the abutment arm 14 is formed at a central portion of the lock arm 25. An advance stop projection 28 for the engagement projection 11 of the stop arm 12 is formed on the rear end of the division connector 2.

On the other hand, a release lever 31 of a generally hook-shape, having an abutment release projection 30 for the slanting projection 16 of the abutment arm 14, is formed upright on a left portion of a bottom of housing 29 of the body-side connector 4 cooperating with the door-side connector 3. The abutment release projection 30 is disposed on a vertical extension line of the engagement projection 26, and has a projection surface 30*a* having a width equal to or larger than that of the horizontal engagement surface 26*a* of the engagement projection 26. Similarly, an abutment release projection 32 for the double lock spacer 20 is formed on a right portion of the bottom of the body-side connector housing 29. The body-side connector 4 is vertically passed through a panel hole 5*a* from a rear side (the wire lead-out side), and is retained laterally.

Figure 2:
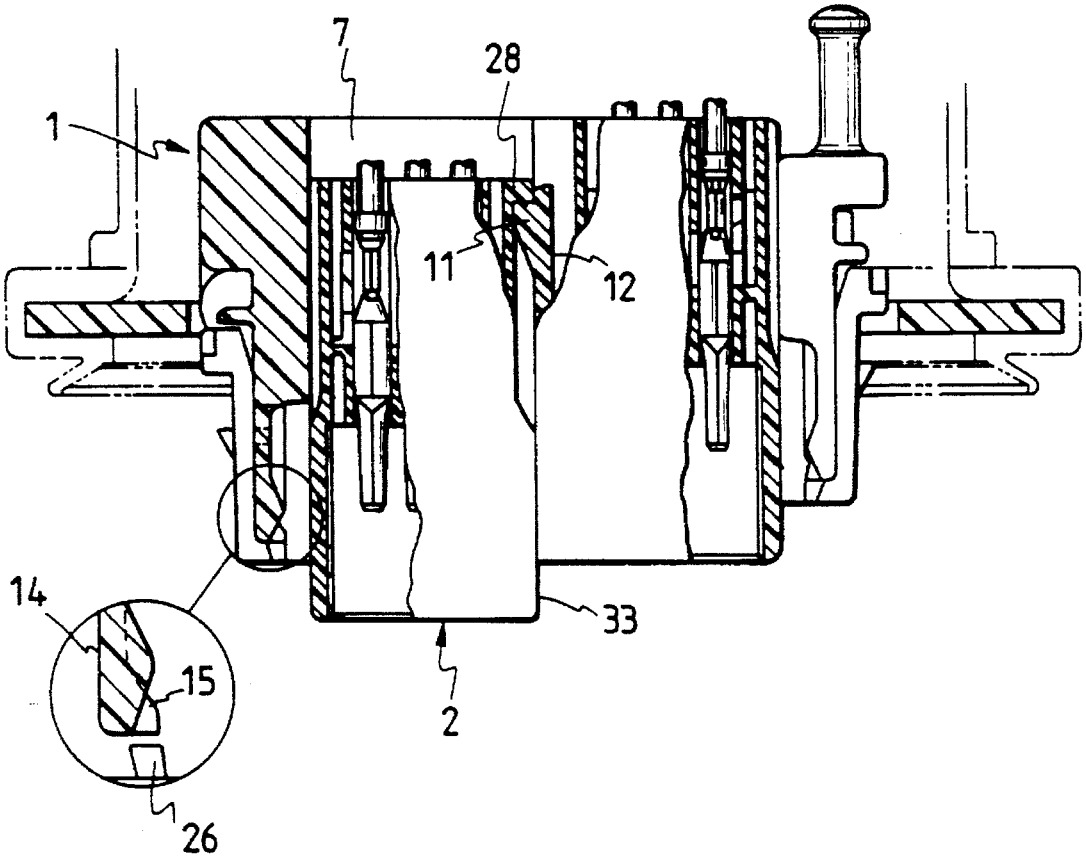
FIG. 2 is a vertical cross-sectional view showing a door-side connector.

As shown in FIG. 2, the division connector 2 is inserted into the guide hole 7 of the door-side connector body 1, with its rear end first introduced into this guide hole, and the stop projection 28 at the rear end flexes the stop arm 12, and is abutted against the rear end of the engagement projection 11. At the same time, the engagement projection 26 abuts against the abutment projection 15 of the abutment arm 14, so that the division connector is held against forward and rearward movement, with its connection portion 33 projected forwardly.

Figure 3:
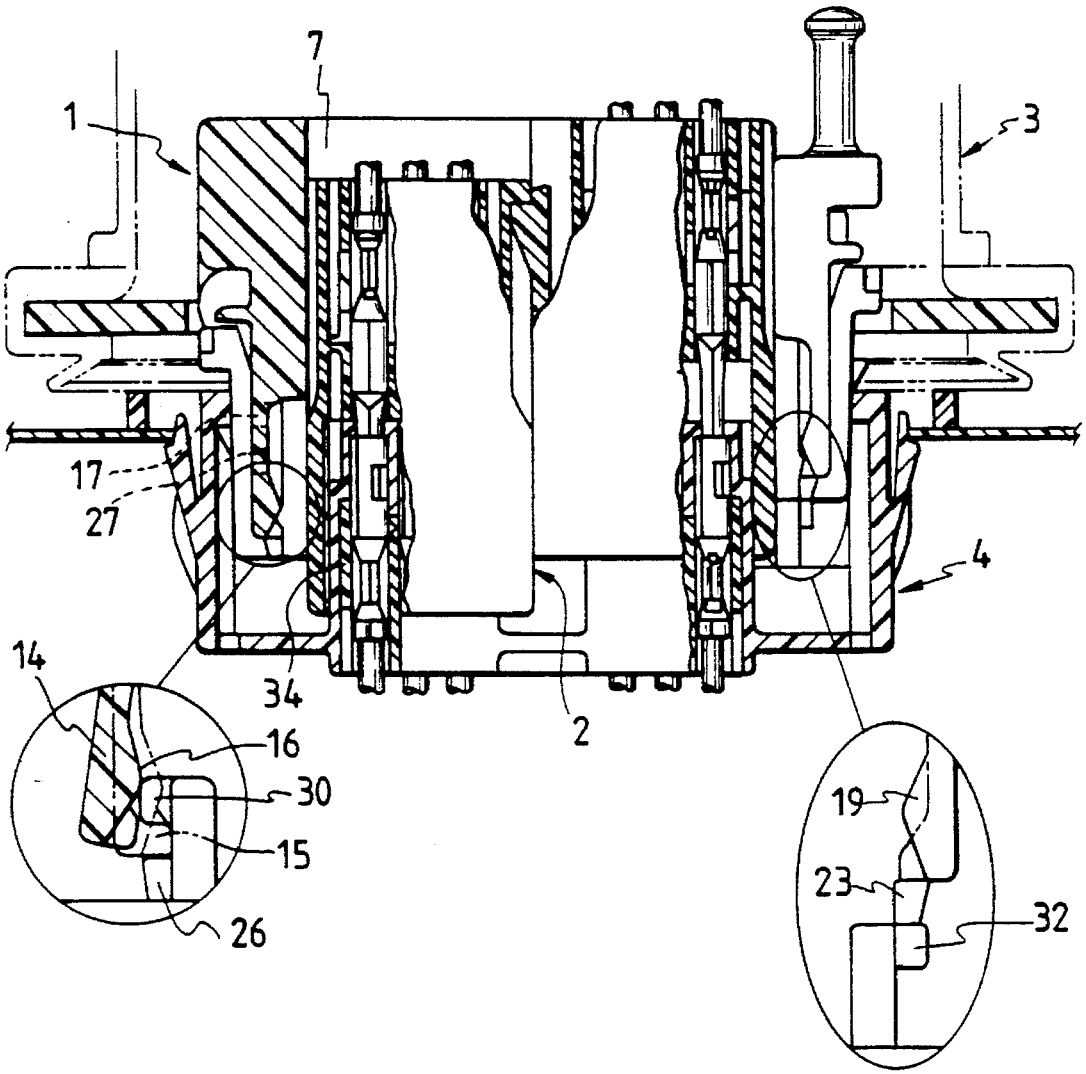
FIG. 3 is a vertical cross-sectional view showing a condition in which a division connector on the door-side connector is fitted in a body-side connector.

FIG. 3 shows a condition in which the division connector 2 is fitted in the body-side connector 4, which is one stage for fitting the door-side connector 3 in the body-side connector 4.

Namely, as shown in an enlarged view within a circle, the engagement projection 26 is abutted against the abutment projection 15 of the abutment arm 14 (in a dots-and-dash line) to prevent the rearward movement of the division connector 2, and in this condition the division connector 2 is fitted on a left connection portion 34 of the body-side connector 4. Here, immediately before the fitting is completed, the abutment release projection 30 of the body-side connector 4 urges the slanting projection 16 of the abutment arm 14 (a solid line in the circle) to flex the arm 14 outwardly to release the engagement between the engagement projection 26 and the abutment projection 15.

As a result, the division connector 2 having the engagement projection 26 can move rearwardly in the guide hole 7 of the door-side connector body 1, and at the same time the door-side connector body 1 having the abutment arm 14 can move forwardly toward the body-side connector 4.

Figure 4:
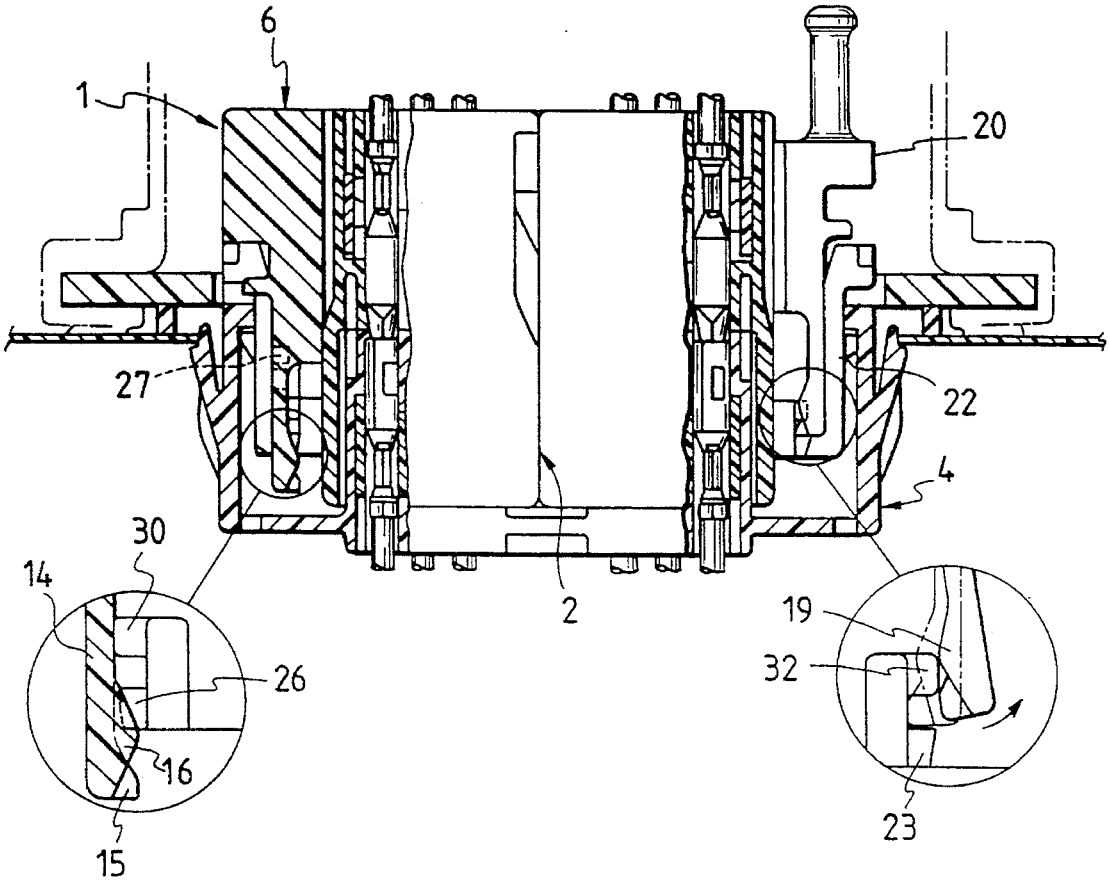
FIG. 4 is a vertical cross-sectional view showing a condition in which the two connectors are completely fitted together.

Then, as shown in FIG. 4, the door-side connector body 1 is fitted in the body-side connector 4, and the staged fitting of the division connector 2 and the door-side connector body 1 is achieved. Here, the engagement projection 26 and the release projection 30 pass past the projections 15 and 16 of the abutment arm 14, respectively, and are disposed within the door-side connector housing 6, and the engagement projection 27 of the division connector 2 slides over the retaining projection 17, and is engaged therewith, thereby completely retaining the division connector 2 relative to the door-side connector body 1.

Figure 5:
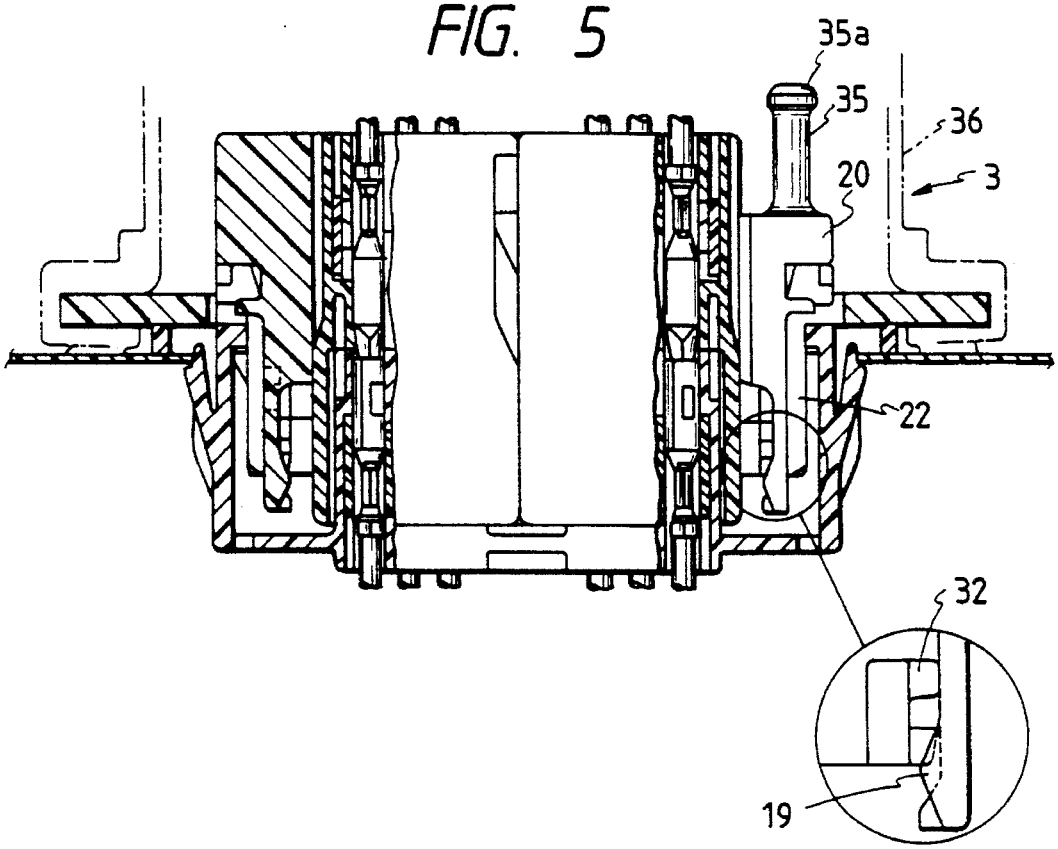
FIG. 5 is a vertical cross-sectional view showing a condition in which a double lock spacer is inserted.
Figure 6:
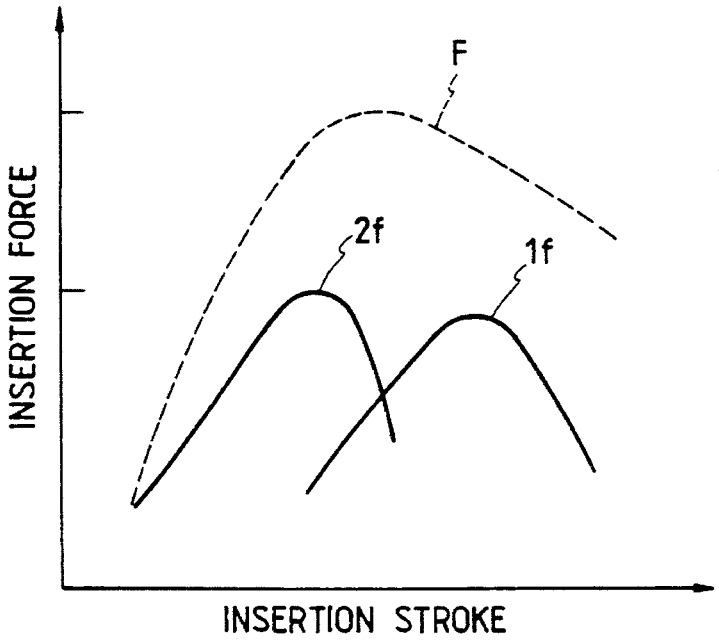
FIG. 6 is a diagram showing the relation between a connector insertion force and an insertion stroke.
Figure 7:
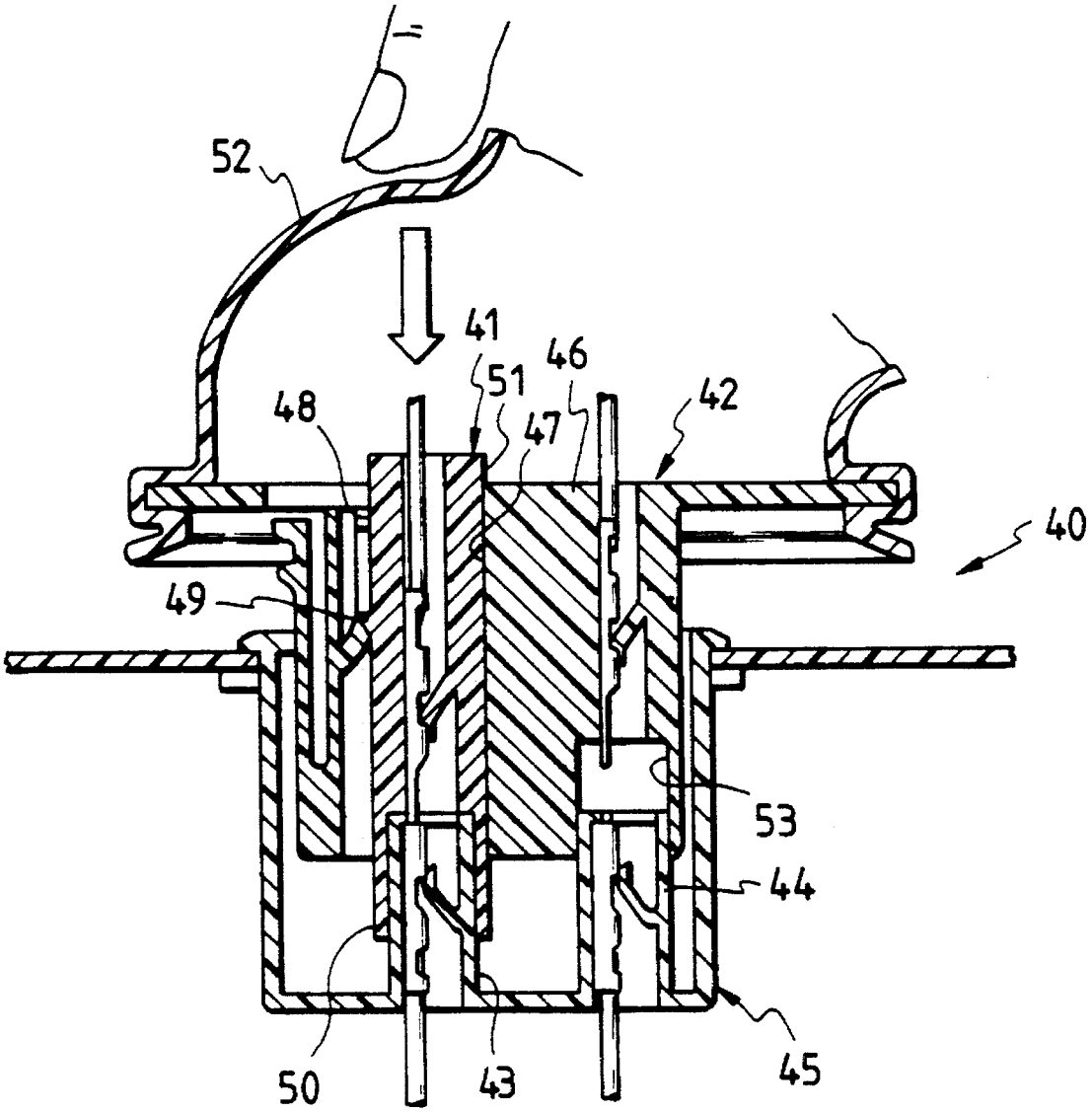
FIG. 7 PRIOR ART
FIG. 7 is a vertical cross-sectional view of a conventional example.

In this condition, the double lock spacer 20 is urged at the slanting projection 19 by the release projection 32, and is flexed outwardly to be disengaged from the abutment projection 23 as shown in a right circle, and advances inside the lock arm 22, as shown in FIG. 5. When the connector is not in the fitted condition, a rear operating lever 35 of the lock spacer 20 is projected exteriorly from a tight hole (not shown) in a waterproof grommet 36 mounted on the door-side connector 3. When the insertion of the spacer is completed after the fitting of the connector, the lever 35 except for its head 35*a* is completely received in the grommet 36, thereby enabling the completion of the locking to be detected.

In the above low insertion force connector, the division connector 2 and the door-side connector body 1 are fitted in the body-side connector 4 in a staged manner with two divided insertion forces 2*f* and 1*f*, and therefore the operating force can be half an insertion force F required for a conventional connector, and the efficiency of the fitting operation can be enhanced markedly.

In the above embodiment, although the fitting of the connector is effected in a two-staged manner, the fitting can be made in a multi-division manner such as a three-division and a four-division manner, and by changing the positions of the release projection 30 and the abutment arm 14 in the direction of the height, the insertion force can be further reduced. A plurality of release projections 30, as well as a plurality of engagement projections 26, can be suitably provided.

As described above, in the present invention, the rearward movement of the division connector is prevented by the elastic abutment arm on one connector, so that the division connector can be fitted in the other connector, and the engagement between the abutment arm and the engagement projection is released by the release projection of the other connector, so that the one connector can be fitted in the other connector. Therefore, the fitting can be positively effected automatically in a staged manner without the need for a manual operation as required in the conventional construction, and the function of the low insertion force connector can be fully achieved.

What is claimed is:

1. A low insertion force connector comprising:

a first connector (1) having a resilient abutment arm (14) with an abutment portion (15) and a slanting portion (16), and further having a resilient stop arm (12) and an engagement projection (11);

a second connector (4) provided with an abutment release portion (30) for urging the slanting portion (16) to displace the resilient abutment arm (14) when the first connector (1) is fitted to the second connector (4); and a division connector (2) provided with an engagement portion (26) for engaging the abutment portion (15) and an advance stop projection (28) for displacing the resilient stop arm (12) and for engaging the engagement projection (11) when the division connector (2) is inserted in the first connector (1) prior to fitting the first connector (1) to the second connector (4), whereby relative motion of the division connector (2) in the first connector (1) is prevented until the division connector (2) is fully engaged with the second connector (4) when the first connector (1) is partially fitted to the second connector (4), after which the first connector (1) is fully engaged with the second connector (4) so that an insertion force applied only to the first connector (1) effects connection of the division connector (2) with the second connector (4) and connection of the first connector (1) with the second connector (4) in a staged manner to reduce the insertion force.

2. A low insertion force connector as recited in claim 1, wherein the first connector (1), the second connector (4) and the divisional connector (2) are configured so that the abutment release portion (30) engages the slanting portion (16) at the instant the division connector (2) is connected with the second connector (4), thereby disengaging the engagement portion (26) of the division connector (2) from the abutment portion (15) of the resilient abutment arm (14) so that the first connector (1) can be further moved in the fitting direction to be completely connected to the second connector (4).

3. A low insertion force connector as recited in claim 2, wherein said division connector (2) is further provided with an engagement projection (27), and wherein said first connector (1) is further provided with a retaining projection (17), so that, when said division connector (2) is disengaged from the abutment portion (15) of the resilient abutment arm (14) and the first connector (1) is fully engaged with the second connector (4), the engagement projection (27) engages the retaining projection (17) to secure the first connector (1) and the division connector (2) relative to the second connector (4).

4. A low insertion force connector as recited in claim 3, wherein said second connector (4) is further provided with an abutment release portion (32), and wherein said low insertion force connector further comprises a double-lock spacer (20) having an abutment projection (18) and a slanting projection (19) at a proximal end thereof, said double-lock spacer (20) being inserted and movable between a lock arm (22) and an outer wall (21) of a first connector housing (6) of the first connector (1), and wherein said abutment release portion (32) contacts said slanting projection (19) to release said double-lock spacer (20) from engagement with an engagement projection (23) formed on a proximal portion of the lock arm (22) when said first connector (1) is fitted to said second connector (4), said double-lock spacer (20) thereafter advancing inside said lock arm (22) in the fitting direction.

5. A low insertion force connector as recited in claim 4, further comprising a rear operating lever (35) and a grommet (36), wherein when said double-lock spacer (20) is advanced fully inside said lock arm (22), at least a portion of said rear operating lever (35) is received in said grommet (36) thereby enabling completion of the locking to be detected by an operator.

* * * * *